United States Patent [19]

Akers

[11] 4,136,836

[45] Jan. 30, 1979

[54] YARN WINDING METHOD AND DEVICE THEREFOR

[75] Inventor: Richard L. Akers, Wilmington, Del.

[73] Assignee: E. I. Du Pont de Nemours and Company, Wilmington, Del.

[21] Appl. No.: 861,306

[22] Filed: Dec. 16, 1977

[51] Int. Cl.[2] ..... B65H 54/28

[52] U.S. Cl. ..... 242/43 R

[58] Field of Search ..... 242/43 R, 43.2, 158.3, 242/158.5

[56] References Cited

U.S. PATENT DOCUMENTS

| | | | |
|---|---|---|---|
| 2,664,249 | 12/1953 | Wright | 242/43 R |
| 3,361,376 | 1/1968 | Wolff | 242/43.2 |
| 3,480,217 | 11/1969 | O'Brien | 242/43.2 |
| 3,792,819 | 2/1974 | Schippers | 242/43 R |
| 3,797,767 | 3/1974 | Schippers et al. | 242/43 R |
| 3,861,607 | 1/1975 | Schippers et al. | 242/43 R |
| 4,036,447 | 7/1977 | Mino | 242/43.2 |

FOREIGN PATENT DOCUMENTS

| | | | |
|---|---|---|---|
| 1269138 | 4/1972 | United Kingdom | 242/43 R |

*Primary Examiner*—Stanley N. Gilreath

[57] ABSTRACT

A yarn windup for generally cylindrical packages employing dual mode traverse that includes a first traverse device in the form of a reciprocable thread guide and a second traverse device in the form of a grooved roll to take over the traverse stroke near the ends of the traverse stroke of the reciprocating thread guide. The grooved roll is synchronously driven with the reciprocating traverse guide and the unique groove configuration coupled with appropriate yarn laydown on the grooved roller improves package formation.

12 Claims, 15 Drawing Figures

YARN WINDING METHOD AND DEVICE THEREFOR

BACKGROUND OF THE INVENTION

This invention relates generally to a yarn winding apparatus and more particularly to an improvement in a winding apparatus with dual traverse devices.

In yarn winding devices for forming generally cylindrical packages with substantially flat ends of the type employing either a center drive or a surface drive for rotating the yarn package, it is customary to use a yarn traverse mechanism comprising a barrel type traverse cam with right-hand and left-hand helical portions joined by curved reversals for driving a combined traverse cam follower and yarn guide back and forth between parallel fixed guide rails. The cam reversal portions are usually kept as short as possible, consistent with traverse guide rate of acceleration and rate of change of acceleration in the interest of minimizing shoulder build-up or other malformations on the yarn package. In effect, this imposes an upper limit on the speed at which yarn may be wound since operation at speeds higher than the design speed would result in early destruction of the traverse cam follower.

One way of reducing the effect of high accelerations encountered in barrel cam traverses is to use a dual mode traverse as taught generally by Schippers et al., U.S. Pat. No. 3,797,767 and U.S. Pat. No. 3,861,607 which employ in addition to a driven reciprocable thread guide, a second traversing device in the form of a grooved traverse roll to take over the thread traverse stroke near the respective ends of the traverse stroke of the reciprocable thread guide. A synchronous drive keeps the two traverse mechanisms in step with each other.

Schippers' apparatus has shortcomings in that the grooved traverse roll has a groove configuration such that an appreciable length of yarn (called "uncontrolled yarn length", UYL) extends from the last point of controlling contact on the traverse roll to the actual point of laydown on the package surface; this means that despite the fact that the groove reversal may be "sharp", meaning that it has a small radius, the actual pattern of yarn laydown in the package reversal has a comparatively larger radius accompanied by a loss of stroke and the depositing of more yarn at the respective ends of the package than in the intermediate portions. Further, in the Schippers' apparatus disclosed in U.S. Pat. No. 3,861,607, the package surface is spaced a significant distance away from the grooved roll, being driven from yet another roll. Thus, the uncontrolled yarn length is even longer.

In prior art winders of this type, measures aimed at producing a short yarn laydown curvature, where long uncontrolled yarn length exists, include increasing the groove stroke, sharpening the groove reversal radius and introducing "cutback" (an increase in groove helix angle) on the recess side of the reversal. While such measures may be partially effective in reducing the radius of curvature of the yarn laid on the package, the distorted groove path makes it more difficult for the reciprocating traverse guide to deposit yarn in the groove.

Further, in these prior art type winders, the grooved traverse roll is generally located beneath the first reciprocating traverse such that the yarn length from traverse guide to first point of contact on the grooved roll is quite large further aggravating the problem of having the reciprocating traverse deposit the yarn in the groove of the grooved roll. Again, the effect of this long uncontrolled yarn length between the traverse means is to reduce the stroke of the yarn at its point of entry to the grooved roll, and to modify and increase the radius of yarn laydown curvature generated by the reciprocating guide. The resulting mismatch between the milder reversal curve and shortened stroke of the yarn laid down on the grooved roll by the reciprocating guide and the sharp curve, increased stroke, and "cutback" of the groove will tend to cause the yarn to climb out of the groove. Means of counteracting this tendency include increasing the stroke, sharpening the curvature of the traverse cam track reversal, and adding "cutback" at approach and/or recess, all of which increase the forces on the reciprocating guide and therefore reduce its life at high speeds. Yet another attempted cure is to widen and deepen the roll groove to insure capture and retention of the yarn, which as before stated, increases the uncontrolled yarn length of roll to package and also may cause lateral scrubbing of the yarn when the yarn is dragged over the groove edge. Thus, this general design tends to be self-defeating.

Additionally, when grooves are made deeper in the reversal area relative to groove depth in other portions of the roll, yarn tension at the reversals may increase (where a tension increase is highly undesirable) owing to the changed frictional drag effect of the groove, the surface velocity of the root of the groove having been decreased in proportion to its reduced radius.

SUMMARY OF THE INVENTION

The invention relates to a yarn winding apparatus and a method for winding generally cylindrical cross-wound yarn packages in reciprocating strokes. The apparatus includes a first traverse device having a reciprocable yarn guide for guiding the yarn over the mid range of the strokes and a second traverse device embodying a rotatably driven cylindrical roller having groove means for guiding the yarn at the respective ends of the strokes to impart stroke reversal to the yarn guided therein, said groove means having successive helical, reversal curve, and helical portions in the surface of said roller. The groove means has a cross-sectional profile taken in a plane extending longitudinally through the axis of the roller which comprises successively: a shoulder that faces outwardly from the center of the strokes and extends from its one end from the surface of the roller toward its axis; a valley portion that merges into the other end of said shoulder; and a ramp that extends gradually outward from said valley and away from the axis of the roller, said ramp intersecting the surface of said roller. The method comprises: deflecting the advancing yarn with said first traverse device to deposit it in alternating opposite hand generally helical paths and reversal curves on said cylindrical roller; leading yarn on the roller in a path which is longer and with a curvature of larger radius and longer stroke than that of said preferred path, said yarn occupying stable paths substantially along said helical paths and being unstable in and proximal to said reversal curves; sliding the yarn inwardly in an axial direction on the surface of the roller in a groove on said surface, said groove having a preselected curved stable shape at the respective reversals conforming to said preferred path; and transferring yarn from said roller to a winding yarn package while substantially preserving said stable yarn shape.

DETAILED DESCRIPTION OF THE PREFERRED EMBODIMENT

Figure 1:
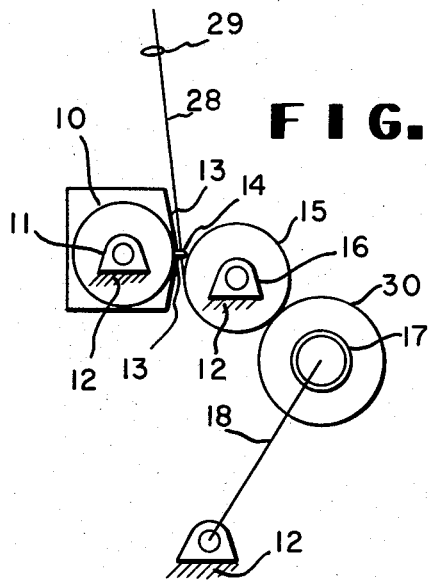
FIG. 1 is a diagrammatic representation in end-elevation of a type of windup to which the present invention is applicable.
Figure 2:
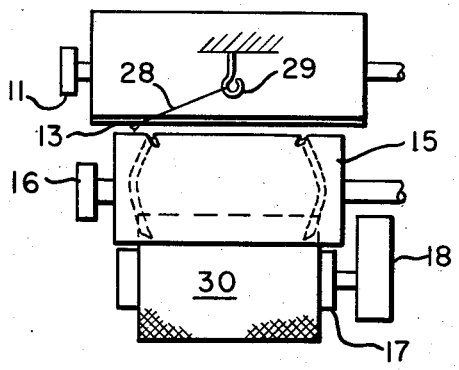
FIG. 2 is a plan view of FIG. 1.

Referring to FIGS. 1 and 2, a typical winder to which the present invention is applicable includes a barrel type traverse cam 10 having a generally helical "endless" groove (not shown) mounted in fixed bearings 11 secured to a machine frame 12 and being generally adapted to drive a cam follower-yarn guide 14 between a pair of fixed rails 13. Immediately in front of the traverse mechanism is a generally cylindrical roll 15, portions of which are described in greater detail below, which is also mounted in bearings 16 on machine frame 12. The traverse cam 10 and the roll 15 are adapted to be power-driven in a specified relationship (to be described) by means of, for example, toothed timing belts (not shown) running to a common motor (not shown).

Beneath the roll 15 and in driven contact therewith, initially, is a bobbin or tube 17 mounted on a suitable chuck on bearings (neither shown) which are carried by a swing arm 18 which, in turn, is pivotally mounted on machine frame 12 so as to permit the tube or yarn package to be urged into contact with the roll 15 throughout a winding period, e.g., by means of a spring (not shown). Alternatively, if desired, the package may be driven independently and separated, slightly, from contact with roll 15.

Figure 3:
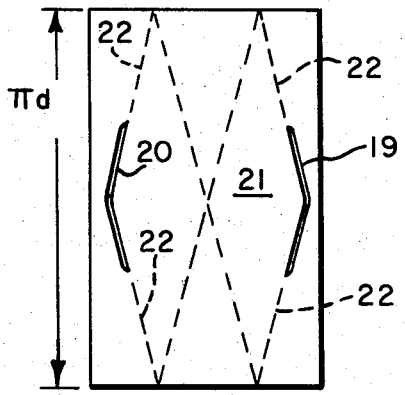
FIG. 3 is a developed view of the surface of the shouldered roll of FIG. 2 showing two reversal grooves.

Referring to FIGS. 3–10, the improvement of the present invention comprises one or more shouldered grooves 19 comprising a helical portion, a curved portion and a second helical portion. These grooves are cut into the surface of the roll 15 at a position defining the end of a package to be wound as described more fully below. One or more additional grooves 20 are cut at the opposite end of the roll 15. If the roll surface 21, having two grooves, is developed so that its entire circumference is viewed as in FIG. 3, it will be seen that the grooves 19, 20 have a helical portion at each end which merges with helical lines 22. The lines 22 are shown as broken lines beyond the runout portion of the grooves, for the reason that they have no real counterpart in the roll 15. If the developed view of FIG. 3 is "wrapped" about the circumference of the roll 15, it may be seen that the helical broken lines 22 meet to form a "closed" or endless right- and left-hand helical path much in the manner of a barrel cam.

Figure 6:
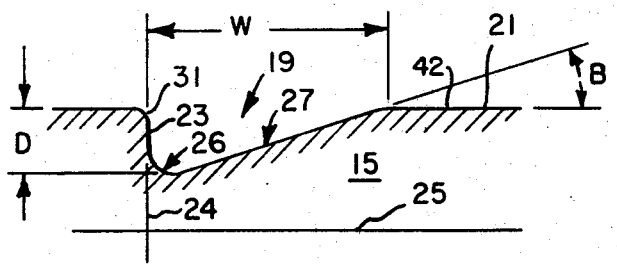
FIG. 6 is a cross-section of the groove of the roll taken along line 6—6 of FIG. 5, at the peak of the reversal, showing the shouldered groove profile and a ramp.

In FIG. 6, the groove 19, 20 has an outwardly facing shoulder 23 which merges into a valley 26 by means of a radius of about 0.25 mm. The opposite end of this radius is tangential with a sloping ramp 27 which is at an angle B of about 15° relative to roll axis 25. Proceeding axially on roll 15, the outer end of the ramp 27 is faired into the outer cylindrical surface of the roll by means of a radius of about 1.25 mm while the shoulder 23 is faired to the roll surface in a much smaller radius of about 0.1 mm, i.e., almost a "sharp" corner 31.

Figure 5:
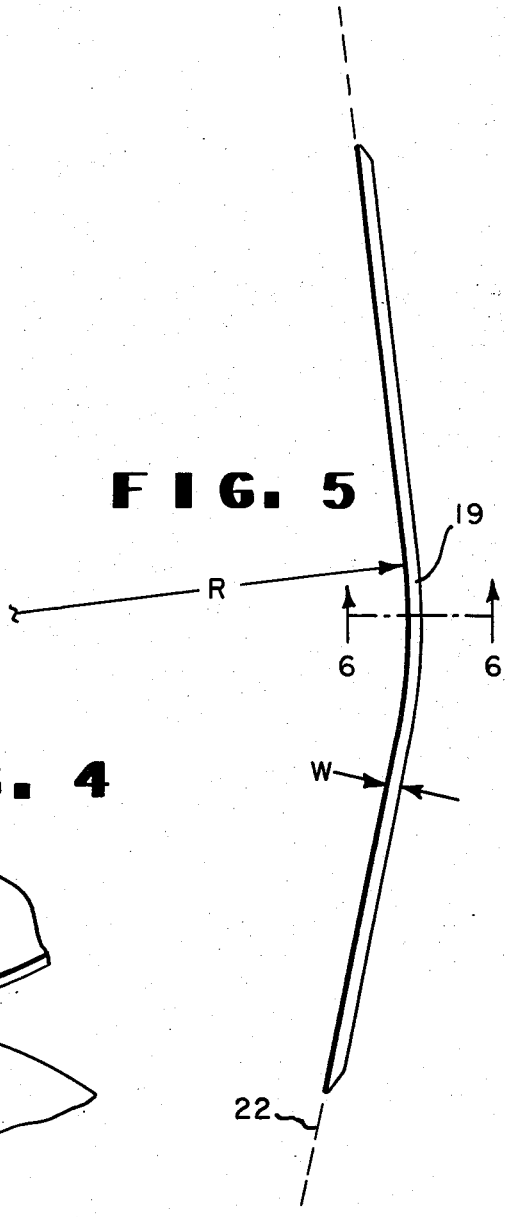
FIG. 5 is an enlarged elevational view of a groove of the roll of FIG. 3.

Referring to FIGS. 5 and 6, the grooves 19, 20 may be seen to have a width W, measured from shoulder 23 normal to the groove path of about 2.5 mm which is substantially constant throughout the reversal. This width diminishes to zero at the extremities of the groove in the "runout" region where the groove decreases to zero depth. Between these runout regions the groove has a constant depth D of about 0.6 mm. On a roll having a radius of about 98 mm, this constant depth portion of the groove may, for example, extend for about 150 to 250 mm, measured circumferentially and each of the runout portions may be about 12 mm long.

Figure 7:
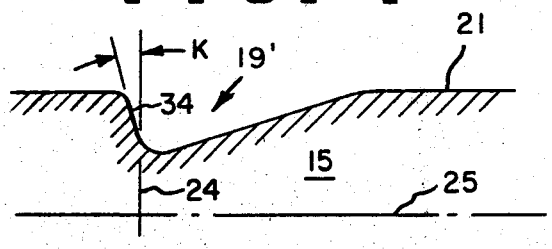
FIG. 7 is a cross-section of a groove of a roll, similar to FIG. 6, except that the groove shoulder is angled.

In another embodiment, FIG. 7, the shoulder 34 of the groove 19' is angled inwardly relative to radial line 24 (toward the center of the traverse stroke) as designated by angle K which may range from zero to about 15°.

Figure 8:
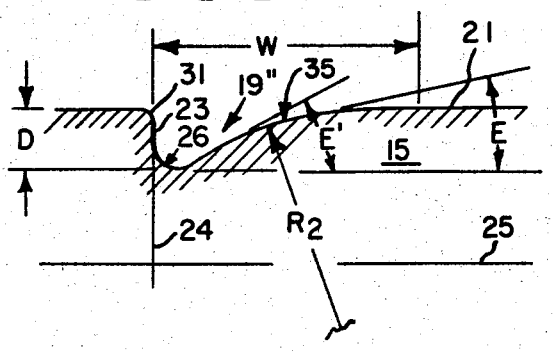
FIG. 8 is a cross-section of a groove of a roll, similar to FIG. 6, except that the groove has a curved ramp profile.
Figure 9:
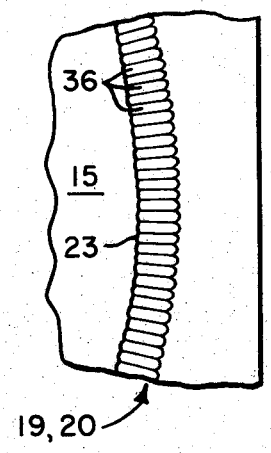
FIG. 9 is a developed or plan view of a portion groove showing details of a machined finish in the groove.

FIG. 8 shows another embodiment, groove 19'' wherein the sloping ramp 27 (of FIG. 6) is replaced by a convex curved ramp 35 of relatively large radius (e.g., 20 mm) such that the slope E of the ramp gradually increases from zero degrees at the "outside" of the curved ramp (on the right) to the valley 26 where angle E' may be about 15°.

Figure 10:
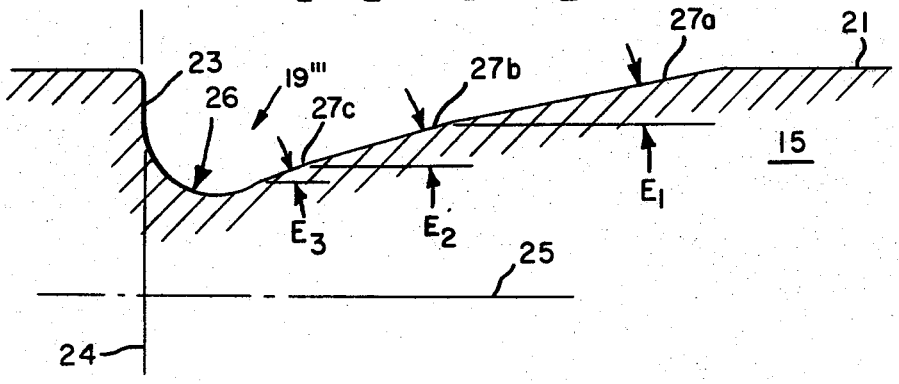
FIG. 10 is a cross-section of a groove of a roll, similar to FIG. 6 except that the groove ramp profile is a succession of three intersecting angled ramps.

FIG. 10 discloses still another embodiment wherein the groove 19''' is characterized with a ramp composed of a succession of intersecting angled ramps 27*a*, 27*b*, and 27*c* of progressively greater slopes $E_1$, $E_2$ and $E_3$, respectively from the axis 25 of roll 15.

With reference to FIGS. 6, 7, 8 and 10, it should be noted that a line 24 drawn perpendicular to the axis 25 of the roll 15 will coincide with at least a portion of the shoulder 23 (or in the case of an angled shoulder 34, substantially tangent). At the peak, this defines a reversal point, and the position of the maximum "stroke" of a particular groove. This concept of a "stroke" is compared with other stroke lengths as discussed further below.

The surface finish on roll 15, including the surfaces of the grooves 19, 20 is selected to minimize the coefficient of friction relative to yarn. One surface found to be satisfactory is chrome oxide which is given a matte finish as taught generally by R. P. Steijn, U.S. Pat. No. 3,080,135. If desired, different areas of the roll 15 may be finished in different ways; for example, the main or cylindrical portion of the roll 15 may have a matte finish, as above, while the sloping ramp 27 may have a low-friction undulating finish acquired by machining as depicted generally in FIG. 9 in which a plurality of curved "scallops" 36 are obtained by advancing a ball-shaped, small diameter (e.g., 0.8 mm) milling cutter radially into a roll surface in plural successive parallel and mutually intersecting cuts to form the surfaces of the ramp 27 in grooves 19, 20 while simultaneously cutting the shoulder 23 of such a groove. The line of intersection between successive scallops is smoothed but not completely obliterated by polishing or grit blasting and may be plated or coated, if desired.

In operation yarn 28 descends from a fanning guide 29, through traversing guide 14, part-way around roll 15 in generally helical paths and thence to a package 30 on tube 17 (FIG. 1). It will be realized that the drives of the traverse cam 10 and of the roll 15 must be timed and synchronized; the latter is easily accomplished by positively driving them, e.g., by means of timing belts, from a common motor while timing is accomplished by adjusting their relative angular position.

The stroke of the traverse guide 14 at the peak of its reversal is such that the yarn which is to be deflected from a helical shape to be reversed is carried out to a maximum position axially beyond the location of the shoulder 23 but preferably not beyond the outer edge of the grooves 19, 20. Thus, the "stroke" of the grooved roll 15 is exceeded by the stroke of the yarn as deposited on the roll 15 by the traverse guide 14, e.g., by about 1.0 mm at each end. In other regions of the reversal (i.e., off the peak), the traverse guide 14 will position the yarn beyond the shoulder 23; however, the axial distance yarn-to-shoulder (23) may vary considerably.

Figure 11:
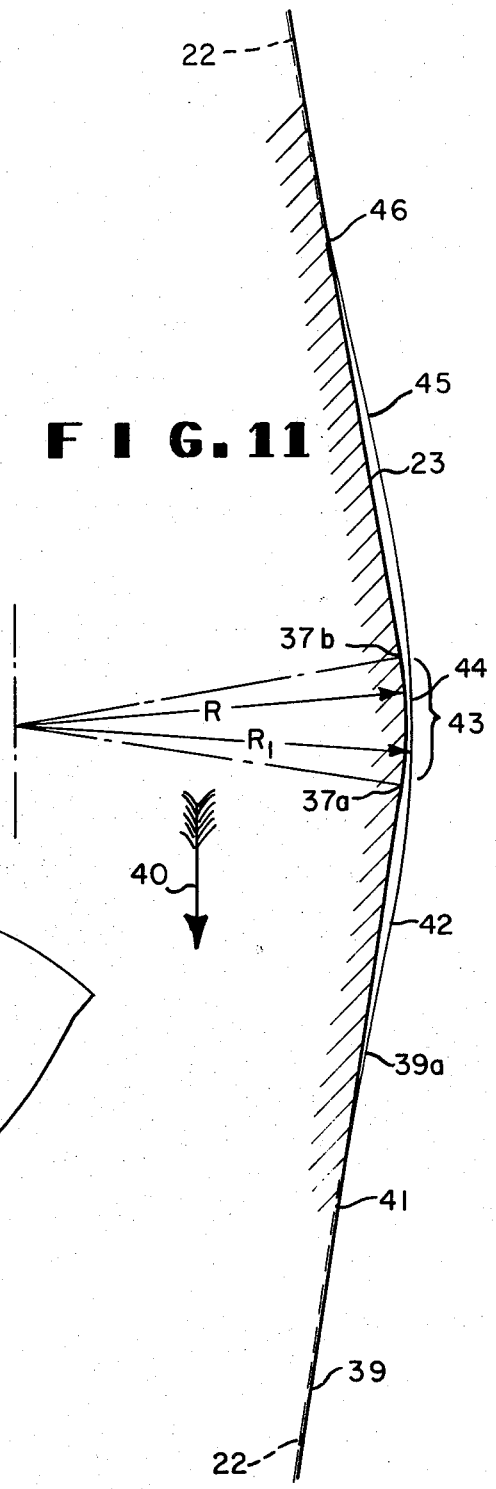
FIG. 11 is a developed or elevational view of a shoulder on a roll showing a yarn path adjacent thereto.

Further, in accordance with the present invention, the profile of the traverse cam 10 is arranged to present yarn to the roll 15 and more particularly to the shoulder 23 of the grooves 19, 20 in a preselected manner. In order for yarn approaching or entering a reversal to be deposited on roll 15 "outside" shoulder 23, the helix angle of the yarn must be increased momentarily relative to the helix angle of yarn just deposited on the roll 15, i.e., the traverse guide must be accelerated outwardly momentarily in the direction of increasing stroke length, for convenience called positive acceleration. This is illustrated diagrammatically in FIG. 11 in which broken lines 22 represent purely helical yarn paths on roll 15 while the cross-hatched portion of the diagram delineates the part of the face of shoulder 23 which defines the desired yarn configuration in the reversal; for example, a curving shoulder surface of radius R extending from point **37*a* to 37*b* and merging tangentially at each end with a helical line 22. In this diagram the yarn will be considered to be deposited at the bottom portion first, i.e., the surface of the roll 15 is moving downward (arrow 40). Starting at the bottom of the diagram, the yarn follows the helix 22 along line 39 (shown slightly to one side of line 22 so as not to obscure it) being guided to that helical path by traverse guide 14; starting at a point 41 some 75 mm to 100 mm (measured circumferentially on roll 15) from the point 37*a* on the shoulder 23, the yarn is caused to diverge from the helical path along line 39*a* by arranging cam 10 to start to accelerate the cam follower-yarn guide 14** in the positive direction.

The positive acceleration (i.e., to the right in FIG. 11) period is maintained for only a very short time (e.g., for a few degrees of advance on the roll 15) for two reasons; first, the actual yarn path should not diverge axially from the desired path, represented by the helix 22 and the shoulder 23, by more than about 4 mm as detailed further below; and, second, any increment of increase in the positive velocity of the traverse guide 14 has ultimately to be counteracted by negatively directed accelerations to effect at least a corresponding decrease in velocity. Thus, in accordance with one aspect of the present invention, in the approach to a traverse reversal (and consequently a yarn reversal) the initial amount of axial departure from a purely helical path is kept to a small preselected value. It will be realized that the yarn displacement will lag the traverse displacement slightly.

As the yarn is carried along divergent line **39*a*, positive acceleration diminishes to zero and negative acceleration of the yarn guide 14 is effected by the cam 10 starting approximately at point 42 so that the yarn portion then being laid down on roll 15 and entering the reversal region 43 lies in a generally curving path of Radius $R_1$ which may be generally larger than Radius R; Radius $R_1$ is not necessarily constant but may decrease progressively to a minimum at the yarn reversal; on this approach side of the reversal region 43 the negatively directed acceleration of the cam follower-yarn guide 14 continues to effect a reduction in the velocity of the guide 14 until its positive velocity reaches zero and guide reversal occurs. Continuation of the negatively directed acceleration of the guide 14 causes a progressive increase in its negative velocity; yarn is of course carried with the guide, effecting actual yarn reversal with a small lag at point 44, so that the yarn is now led into the path shown by line 45, thus continuing the laydown of yarn "outside" the ultimately desired path of helix 22 — shoulder 23. Negative acceleration of the yarn guide 14 continues at a decreasing rate during which there is a concomitant increase in guide negative velocity until approximately point 46 where all acceleration ceases momentarily and the velocity of traverse (also momentarily) becomes constant, the helix angle at this point being slightly higher than that of the desired helical line 22. Immediately above point 46 (FIG. 11), positive acceleration is next applied for a short period to decrease the helix angle bringing the traverse and the yarn to the desired helical path 22** after which there is no further acceleration and a constant traverse velocity-constant helix angle yarn path prevails until the next reversal occurs.

In effecting the laydown of yarn as described above, it is desired not only to place the yarn in the specified path on roll 15, but also to have the yarn migrate axially relative to roll 15 into the more highly desired configuration defined by the helical line 22 and the shoulder 23; in general, this is accomplished by yarn tension inherent in the winding operation but it is enhanced, according to the present invention, by means of the angled ramp and/or the convex radiused portion of the grooves 19, 20. Considering yarn behavior in or near the angled ramp type groove 19, 20, yarn in the reversal taken as a whole is being laid, deliberately, along a path (39a, 42, 43, 45, 46) rather far (1.0 to 3.5 mm) from the helix 22 and the shoulder 23 which means, referring to FIG. 6, that the yarn may occupy varying positions from about point 42 inward (i.e., leftward).

The yarn path (FIG. 11) in the approach side diverges from helical line 22 and shoulder 23 to a maximum distance of 2.5 to about 3.5 mm in the vicinity of point 42, then because the yarn radius of curvature $R_1$ is larger than the radius of curvature R of shoulder 23, the yarn converges toward shoulder 23 to a distance from shoulder 23 of from about 0.2 mm to about 1.0 mm at or about the peak of the reversal (generally in region 43). Thus, the yarn in the approach region momentarily occupies a curving path on roll 15 in which it is generally unstable which is to say that yarn in such a curved configuration, being under tension, will try to occupy a shorter path length; therefore, the effect of tension alone is to cause the yarn to migrate sidewise. This effect is enhanced according to the present invention in that when the yarn is deposited on or has migrated to the sloping surface or ramp 27, usually the yarn will continue to migrate or slide sidewise into valley 26 into abutment with the shoulder 23 and substantially into alignment with the helical path 22. The yarn behavior in the recess side, starting at region 43 and progressing along line 45 and through point 46 is similar; i.e., is initially "bowed" out but quickly seeks a shorter path so that it migrates throughout its length toward shoulder 23 and helical path 22 at the completion of the reversal. Farther downstream yarn is progressively transferred from roll 15 to a package 30.

In the above-described embodiment as the yarn slides toward a stable condition, the lateral component of yarn tension, though initially high, may tend to diminish to the degree that the desired sidewise migration of the yarn may not be completed owing to frictional drag. This situation may be avoided by recourse to the embodiments of FIG. 8 in which the groove surface is a convex curved ramp of radius $R_2$ of about 18 mm. It may be seen by inspection that the slope E of a tangent to the ramp 35 becomes progressively greater toward the left; therefore, a tensioned yarn segment lying on the part of the curved ramp having a greater slope will be more prone to migrate sidewise to the left, even under diminishing tension, than a yarn segment which is lying on a portion or lesser slope. The embodiment of FIG. 10 functions in the same manner by presenting a progressively greater slope to the left.

Stated differently, it requires a smaller lateral component of yarn tension to effect a sidewise movement of yarn, initially situated on a slope, which yarn subsequently moves to a region of greater slope. In order to avoid having the yarn reach a stable or stationary condition short of the shoulder 23, the angle E' (FIG. 8) is preselected to be greater than the effective angle of repose of the yarn, for example about 15°.

By effective angle of repose is meant the greatest angle, measured from the roll axis, of a surface at which the yarn will not slip sidewise under the instant conditions of speed, tension, yarn friction on the said surface, yarn path shape and the like. In an actual roll this angle, which may vary at different positions on the ramp, should not be greatly exceeded since this would result in too great a groove depth.

In the reversal region 43 (FIG. 11), yarn is initially laid down in spaced relation from shoulder 23. In the interest of keeping the traverse cam 10 stroke as short as possible, this space is made small but not so small as to allow the yarn to be deposited on the roll 15 cylindrical surface to the left of the groove 19, 20, i.e., to the left of shoulder 23. Thus, this space is preselected to be from about 0.2 mm to about 1.0 mm.

If the yarn package is in driving contact with the roll 15, the depth D of the groove ideally would be equal to the thickness of the yarn bundle being handled; in practice, however, such a value is impractically small. Referring to FIG. 8, a depth of about 0.6 mm has been found to be effective for filament yarns as discussed further below. For a given angle E of 15° and radius $R_2$ of about 18 mm, the width W will be about 5 mm.

Figure 4:
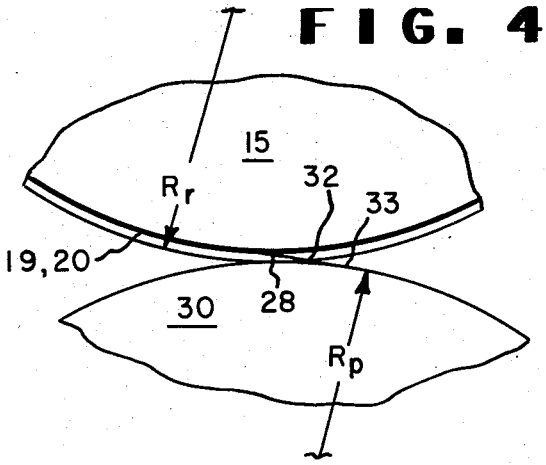
FIG. 4 is a transverse cross-section of the roll and a portion of a yarn package wound therefrom showing the yarn path from reversal groove to package.
Figure 12:
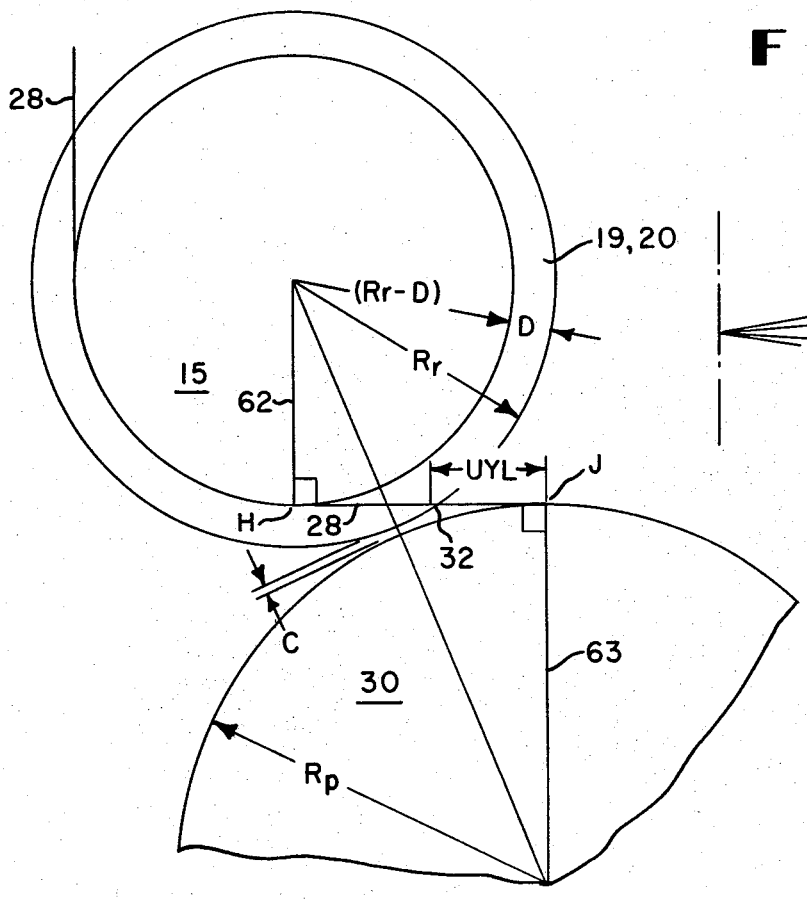
FIG. 12 is an end-elevational view of a grooved roll and a yarn package in diagrammatic form useful in geometric analysis of yarn paths.

As best seen in FIGS. 4 and 12, when yarn is transferred from a grooved roll to a package, a length of yarn spans a space from the roll to the package through which it is used to be "uncontrolled". This means that a finite length of yarn is not guided or restrained in any way and this is called the uncontrolled yarn length. The true length of yarn in this space is in fact slightly longer (except at the peak of the reversal) being equal to the distance from point 32 and point J divided by the cosine of the instant yarn helix angle. Since helix angles are usually small, the correction is small and will be neglected. For convenience, the distance from point 32 to point J (FIG. 12) will be referred to as the "UYL". As described in greater detail for two separate cases, below, this UYL may be minimized in Case I where surface contact between package 30 and roll 15 is present (FIG. 4) or the UYL may be optimized in Case II in which the package 30 is spaced away from roll 15 (FIG. 12).

In Case I (surface contact), the UYL may be held to a minimum by making the shoulder 23 depth as small as possible (FIG. 6, Depth D) but large enough to be capable of retaining the yarn and by providing a sharp (very small radius, if any) substantially 90° corner 31 where the inside shoulder 23 intersects the roll 15 outer cylindrical surface. The latter is important because even though the yarn is nominally lying in the bottom of the shallow valley 26 and against shoulder 23, nevertheless, as it is "peeled off" roll 15 to go to package 30 since it is continually changing direction in the reversal it will graze corner 31, thus the last point of controlling contact that the yarn experiences with roll 15 is along this corner 31 shown also in FIGS. 4 and 12 as point 32. Thus, the UYL extends from point 32 to the point 33 of laydown on the yarn package 30. From the geometry of the situation, it will be seen that for Case I the UYL is as short as it is practical to make it. In effect, this means that the yarn will lose very little of the reversal shape and/or radius of curvature it had on roll 15 when being transferred to package 30.

For Case II (FIG. 12) where a finite but usually small clearance C exists between package 30 and roll 15, one of the considerations of Case I applies, namely, to provide a sharp corner 31. However, in determining or optimizing the UYL, the procedure is slightly more complex because, for a given size roll 15 of radius $R_r$ and with clearance C held constant, the UYL is a function of two variables, the shoulder depth D and the size of the package 30 expressed as radius $R_p$. Yarn 28 enters groove 19, 20 of roll 15 generally vertically (from traverse guide 14, not shown) and proceeds about 90°, or more, around the bottom (or valley) of the groove, then extends from point H to point J at which the yarn enters the package 30. During the traversing reversal when yarn in the groove 19, 20 is transported to the package, the yarn 28 lies against shoulder 23 but, in general, is controlled by its contact with corner 31 (as described above, Case I) thus the UYL extends from point 32 (or corner 31) to point J. At points H and J, the yarn 28 is tangential to the circles representing, respectively, the valley of the groove 19, 20 and the perimeter of the package 30, therefore, at the points of tangency the yarn 28 is at right angles to radial lines 62 and 63. From this geometry, the following equation may be developed:

$$UYL = \sqrt{(C + D)\,[2(R_r + R_p) + C - D]} - \sqrt{D(2R_r - D)} \quad (1)$$

where:

$R_r$ = radius, roll 15
D = shoulder depth, groove 19, 20
$R_p$ = radius, package 30
C = clearance, roll to package Values for UYL may be computed using the above equation; in a practical winder, the following dimensions may be used:

Roll 15 radius, $R_r$ = 98.0 mm
Bobbin radius, no yarn = 42.5 mm
Clearance roll to package, C = 0.7 mm
Shoulder depth, D = variable 0.2 mm to 4.0 mm Calculated values of UYL as a function of increasing yarn package size $R_p$ are as given in Table I.

TABLE I

| Package Radius | Roll to Package Clearance 0.7 mm — Uncontrolled Yarn Length, mm for Groove Depths D, mm | | | | |
|---|---|---|---|---|---|
| $R_p$ mm | 0.2 | 0.4 | 0.6 | 1.6 | 4.0 |
| 42.5 | 9.66 | 8.75 | 8.29 | 7.75 | 8.42 |
| 60 | 10.62 | 9.81 | 9.44 | 9.28 | 10.62 |
| 80 | 11.65 | 10.95 | 10.69 | 10.94 | 13.00 |
| 100 | 12.63 | 12.03 | 11.86 | 12.51 | 15.25 |
| 120 | 13.56 | 13.06 | 12.98 | 14.00 | 17.38 |
| 140 | 14.45 | 14.04 | 14.05 | 15.42 | 19.42 |

Figure 13:
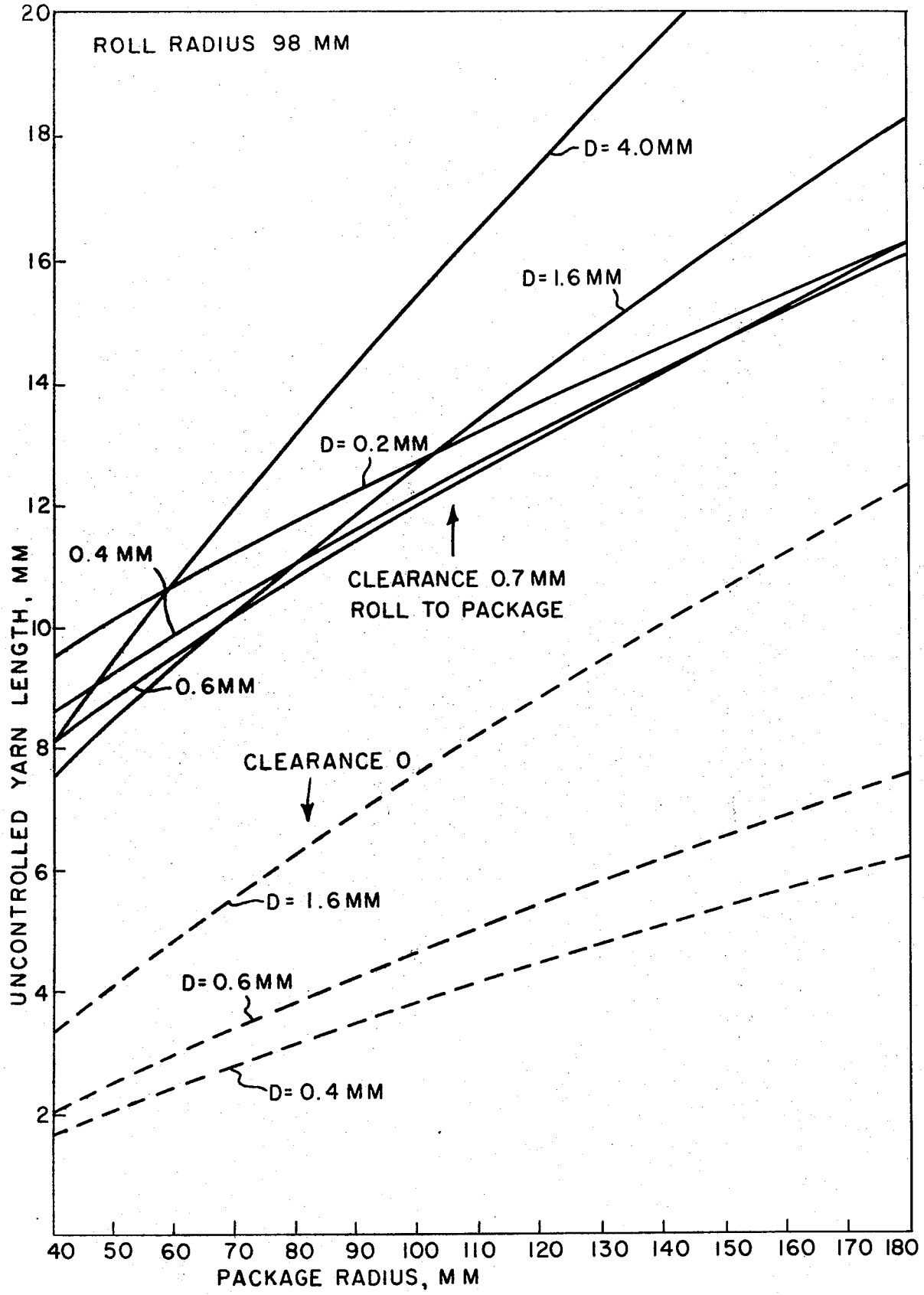
FIG. 13 is a plot of uncontrolled yarn length vs. package diameter as abscissa showing the effects of shoulder depth and of clearance roll-to-package.

Using these values for UYL, curves are plotted as in FIG. 13, of UYL vs. package radius as abscissa for each of a number of different values of shoulder depth D. From this plot, it may be seen that a depth of 0.6 mm results in the shortest UYL over the broadest range of package sizes and, in consequence, is the optimum where a clearance C of 0.7 mm is desired between package and roll and given the above winder dimensions. In FIG. 13, it may also be seen that a very shallow shoulder of D = 0.2 mm produces a relatively large UYL for the low range of package sizes while a deep shoulder of D = 4.0 mm, although producing an acceptable UYL in the very low range of package sizes, has a fast rising and unacceptably large UYL at the upper end of the range of package sizes.

If the clearance C is reduced to zero (i.e., package against roll) then equation 1 reduces to:

$$UYL = \sqrt{D\,[2(R_r + R_p) - D]} - \sqrt{D\,(2R_r - D)} \quad (2)$$

Using equation 2, values for UYL are calculated, Table II; these are plotted in FIG. 13 in broken lines for a number of depths D. From these it may be seen that the UYL is appreciably smaller than in the cases where there was clearance D, package to roll. Further, it may be seen that the curves for different values of shoulder depth do not cross over each other and in consequence there is no optimum value; rather, the best dimension for shoulder depth D is the smallest which produces an acceptable groove width W (FIGS. 6 and 8), but which is not so small as to permit yarn to "escape"; e.g., for filament deniers, D should be about 0.6 mm.

TABLE II

| Package Radius | Roll to Package Clearance O — Uncontrolled Yarn Length, mm For Groove Depths D, mm | | |
|---|---|---|---|
| Rp, mm | 0.4 | 0.6 | 1.6 |
| 42.5 | 1.75 | 2.14 | 3.51 |
| 60 | 2.39 | 2.93 | 4.79 |
| 80 | 3.08 | 3.77 | 6.18 |
| 100 | 3.73 | 4.57 | 7.48 |
| 120 | 4.35 | 5.34 | 8.73 |
| 140 | 4.95 | 6.06 | 9.91 |

The present invention is a marked contrast to the prior art in many respects, one of which may be seen by reference to FIG. 13. Some prior art devices for dual mode traverse winders employ deep yarn grooves and even go so far as to suggest the use of progressively deeper yarn grooves in reversals. Reference to FIG. 13 shows, however, that for 0.7 mm roll to package clearance and 4.0 mm groove depth (upper line in FIG. 13) the uncontrolled yarn length becomes unmanageably large above about 70 mm package radius ranging up to as much as 20 mm at 150 mm package radius and becomes rapidly worse above that size. As a consequence, the radius of curvature of the yarn laid on the package will be greatly increased, resulting in a relatively high shoulder buildup in the package.

Figure 14:
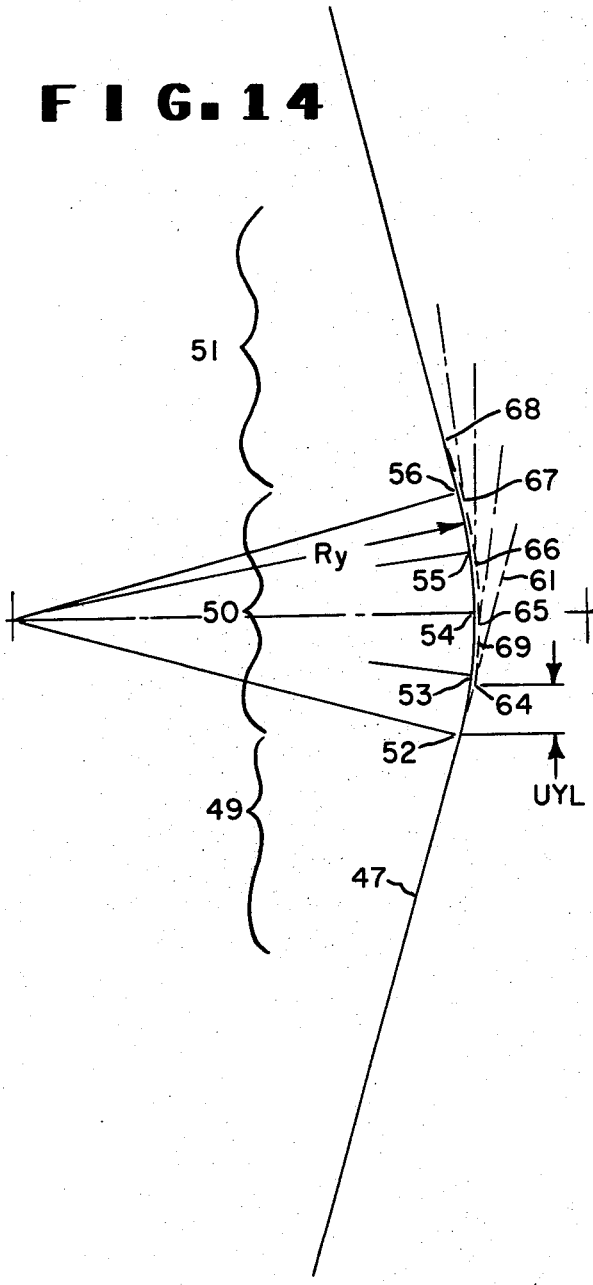
FIGS. 14 and 15 are developed or elevational views of yarn in reversals of identical shape but showing the effect of different uncontrolled yarn lengths in the traverse path needed to effect the yarn path.
Figure 15:
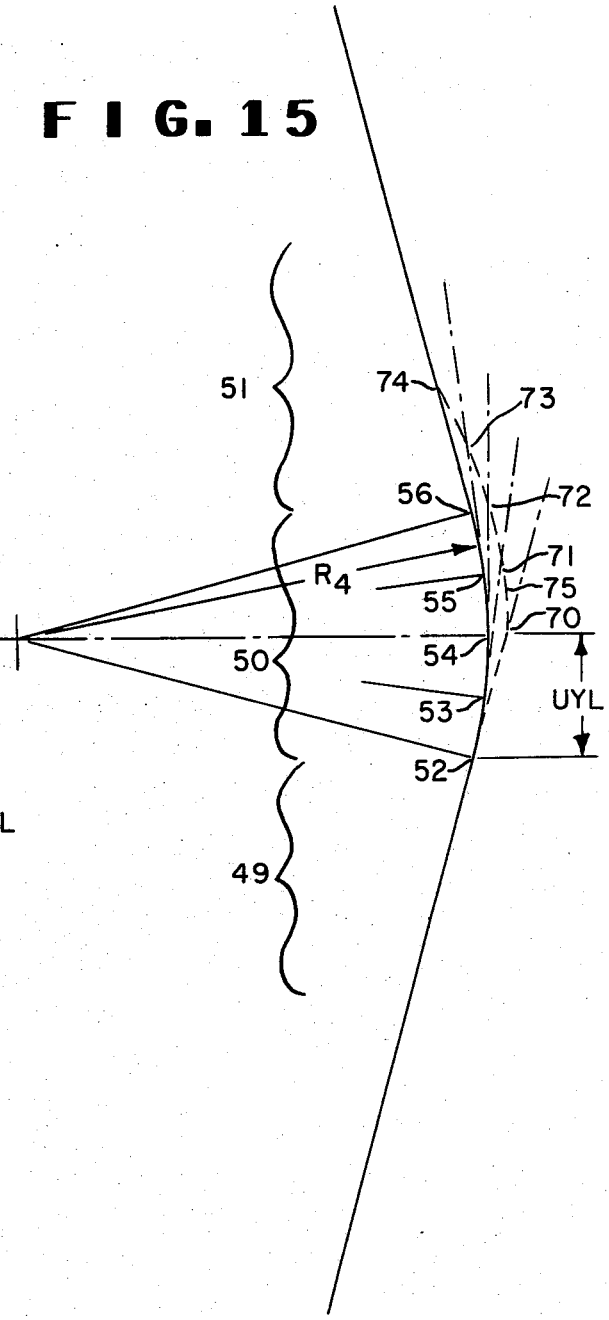

The harmful effect of an increase in uncontrolled yarn length may be seen with reference to FIGS. 12, 14 and 15. In a preferred embodiment, yarn 28 proceeds from the last point 32 of control on the surface of roll 15 across the uncontrolled distance UYL, and into contact with the package at point of tangency J. In FIG. 14, a development of the desired path 47 of the yarn on the package 30 is shown as solid line 47 including a constant helix angle approach portion 49 terminating at tangent point 52, a reversal curve 50 of radius $R_y$, beginning at point 52 and terminating at point 56, and a constant helix angle recess portion 51 which leads from point 56 to the next reversal (not shown). Point 54 is the peak of the yarn reversal while points 53 and 55 are representative intermediate points.

In order to effect the desired yarn path, line 47, any yarn control point on roll 15 (e.g., point 32, FIG. 12) must lie generally above (in the drawing) its corresponding point 52 to 56, respectively, by a distance equal to the UYL, along a tangent to the yarn path 47 from the particular point being considered. Thus, point 64, which is to lead and guide yarn instantaneously into (or across) point 52, must lie on a tangent at point 52 which in this case is an extension 61 of the approach 49 helical path. Similarly, to lead and guide the yarn progressively through the points 53 to 56, inclusive, the corresponding control points 65 to 68 must each lie on a tangent drawn to the respective points 53 to 56 of the reversal curve 50. As the reversal is completed, the last control point 68 must lie on the recess 51 helical line after which the control point will follow the helix to the next reversal. The locus of the control points 64 to 68 will thus lie along the broken line 69 joining these points.

If, for purpose of illustration, the UYL is now taken to be larger say by three times that in the first instance, above, then the corresponding control points to attain precisely the same yarn path (49, 50, 51) will appear as in FIG. 15 in which points 70 to 74, inclusive, correspond respectively to yarn line points 52 to 56 thus defining a locus along broken line 75.

In FIG. 14, it will be seen that the locus 69 of points 64 to 68 for the shorter UYL differs only slightly from the desired yarn path, 49, 50, 51 and, in practical terms, the difference is so small that it may be neglected; thus, for a small UYL, the shoulder 23 in roll 15 may be machined to the shape of line 47. If desired, however, this slight difference may be substantially compensated by using a shoulder 23 radius (not shown, FIG. 14) slightly smaller than the desired yarn radius $R_y$ so that the maximum "stroke" of shoulder 23 is equal to the "stroke" of the locus 69, e.g., slightly to the right of line 47 in reversal 50; this, then, will result in laydown on the package very close to the desired line 47.

In contrast to the above, for the larger UYL of FIG. 15, the locus 75 of points 70 to 74 is an extremely unfavorable distortion of the desired yarn path 49, 50, 51 being characterized by sharp corners at 70 and 73 and "cutback". If this controlling profile of line 75 represents one side of a groove in a roll (not shown), the yarn must be guided at points 70 through 73 by the side of the groove on the left but at 74 by the opposite (right) wall to produce the abrupt change in yarn direction needed to return the yarn to a helical path. If the groove (not shown) were made wide (to assist in capturing the yarn), the yarn would not be under control at all for that portion of the path in which yarn contact changes from one side of the groove to the other and such a groove would be incapable of placing the yarn in the desired path of line 47. Therefore, in order to control the yarn properly through the points 71 to 74, the groove (not shown) would have to be very narrow.

Considering the locus of line 75 (FIG. 15) even if a roll groove could be provided to "fit" the line, still another problem remains of providing a reciprocating traverse for placing yarn in such a groove. At high speeds, constraints on traverse guide force and "jerk" and maximum cam pressure angles require compromises in the motion of the reciprocating guide which then may require further compromises in the shape of the roll groove, all of which are aggravated if UYL between traverse guide and grooved roll is large or UYL between grooved roll and package is large with the result that the desired sharpest yarn laydown curve on the package can not be realized.

While this invention has been illustrated using a yarn windup employing a separate, traverse and a separate package drive for each threadline, it is to be understood that this invention applies equally well to yarn windups wherein such a traverse and such a package drive will serve two or more threadlines to wind a plurality of packages as disclosed by Pollock in U.S. Pat. No. 2,647,697.

I claim:

1. In a yarn winding apparatus for winding generally cylindrical cross-wound yarn packages in reciprocating strokes, said apparatus including a first traverse device having a reciprocable yarn guide for guiding the yarn over the mid range of the strokes and a second traverse device embodying a rotatably driven cylindrical roller having groove means for guiding the yarn at the respective ends of the strokes to impart stroke reversal to the yarn guided therein, said groove means having successive helical, reversal curve, and helical portions in the surface of said roller, the improvement of which comprises:

said groove means having a cross-sectional profile taken in a plane extending longitudinally through the axis of the roller comprising successively:

a shoulder facing outwardly from the center of the strokes and extending from its one end from the surface of the roller toward its axis said shoulder being at an angle of up to 15 degrees with a plane normal to the axis of the roller;

a valley portion merged into the other end of said shoulder; and a ramp extending gradually outward from said valley and away from the axis of the roller, said ramp intersecting the surface of the roller at an angle of about 15 degrees.

2. In a yarn winding apparatus for winding generally cylindrical cross-wound yarn packages in reciprocating strokes, said apparatus including a first traverse device having a reciprocable yarn guide for guiding the yarn over the mid range of the strokes and a second traverse device embodying a rotatably driven cylindrical roller having groove means for guiding the yarn at the respective ends of the strokes to impart stroke reversal to the yarn guided therein, said groove means having successive helical, reversal curve, and helical portions in the surface of said roller, the improvement of which comprises:

said groove means having a cross-sectional profile taken in a plane extending longitudinally through the axis of the roller comprising successively:

a shoulder facing outwardly from the center of the strokes and extending from its one end from the surface of the roller toward its axis;

a valley portion merged into the other end of said shoulder; and a ramp extending gradually outward from said valley and away from the axis of the roller, said ramp intersecting the surface of the roller, said reversal curve portion of said groove means having a smaller radius of curvature than that imparted to the yarn by said first traverse device and a smaller stroke length than said first traverse device.

3. The apparatus as defined in claim 2, said groove means having a depth not greater than 1.6 mm.

4. The apparatus as defined in claim 2, said shoulder being substantially normal to the axis of the cylinder.

5. The apparatus as defined in claim 2, said shoulder being inclined away from said valley at an angle of not more than about 15 degrees with a plane substantially normal to the axis of the roller.

6. The apparatus as defined in claim 2, said ramp having an undulating surface in the form of a series of contiguous circular segments.

7. The apparatus as defined in claim 2, said ramp having a surface of a series of straight line segments of progressively greater slope from the surface of the roller.

8. The apparatus as defined in claim 2, said ramp having a convex surface.

9. The apparatus as defined in claim 2, said ramp being faired into said surface.

10. In a yarn winding apparatus for winding generally cylindrical cross-wound yarn packages in reciprocating strokes, said apparatus including a first traverse device having a reciprocable yarn guide for guiding the yarn over the mid range of the strokes and a second traverse device embodying a rotatably driven cylindrical roller having groove means for guiding the yarn at the respective ends of the strokes to impart stroke reversal to the yarn guided therein, said groove means having successive helical, reversal curve, and helical portions in the surface of said roller, the improvement of which comprises:

said groove means having a cross-sectional profile taken in a plane extending longitudinally through the axis of the roller comprising successively:

a shoulder facing outwardly from the center of the strokes and extending from its one end from the surface of the roller toward its axis;

a valley portion merged into the other end of said shoulder; and a ramp extending gradually outward from said valley and away from the axis of the roller at an instant angle with said axis that is up to the angle formed by a line connecting the valley portion of the groove means with the surface of the roller that is slightly greater than the angle of repose of the yarn wherein said angle of repose is the greatest angle measured from the roll axis, of a surface at which the yarn will not slip sidewise under the instant conditions of speed, tension, yarn friction on the surface and yarn path shape.

11. In a yarn winding apparatus for winding generally cylindrical cross-wound yarn packages in reciprocating strokes, said apparatus including a first traverse device having a reciprocable yarn guide for guiding the yarn over the mid range of the strokes and a second traverse device embodying a rotatably driven cylindrical roller having groove means for guiding the yarn at the respective ends of the strokes to impart stroke reversal to the yarn guided therein, said groove means having successive helical, reversal curve, and helical portions in the surface of said roller, the improvement of which comprises:

said groove means having a cross-sectional profile taken in a plane extending longitudinally through the axis of the roller comprising successively:

a shoulder facing outwardly from the center of the strokes and extending from its one end from the surface of the roller toward its axis;

a valley portion merged into the other end of said shoulder; and a ramp extending gradually outward from said valley and away from the axis of the roller, no point on the surface of said ramp lying outside a line connecting the valley portion of the groove means with the cylindrical surface of the roller at an angle from the axis of the roller slightly greater than the angle of repose of the yarn wherein said angle of repose is the greatest angle measured from the roll axis of a surface at which the yarn will not slip sidewise under the instant conditions of speed, tension, yarn friction on the surface and yarn path shape.

12. A method of winding advancing yarn with first and second parallel-axis traverse devices adapted to coact and to sweep the yarn along the length of a winding yarn package in a preferred path in which the first traverse device is a reciprocating traverse guide and the second is a generally cylindrical roller having grooves in its surface driven in synchronism with the first traverse, the method comprising: deflecting the advancing yarn with said first traverse device to deposit it in alternating opposite hand generally helical paths and reversal curves on said cylindrical roller; leading yarn on the roller in a path which is longer and with a curvature of larger radius and longer stroke than that of said preferred path, said yarn occupying stable paths substantially along said helical paths and being unstable in and proximal to said reversal curves; sliding the yarn inwardly in an axial direction on the surface of the roller in a groove on said surface, said groove having a preselected curved stable shape at the respective reversals conforming to said preferred path; and transferring yarn from said roller to a winding yarn package while substantially preserving said stable yarn shape.

* * * * *